United States Patent [19]

Fuchs

[11] Patent Number: 4,601,167

[45] Date of Patent: Jul. 22, 1986

[54] APPARATUS FOR MAKING A YARN

[75] Inventor: Helmut Fuchs, Linz, Austria

[73] Assignee: Textilmaschinenfabrik Dr. Ernst Fehrer Aktiengesellschaft, Leonding, Austria

[21] Appl. No.: 626,211

[22] Filed: Jun. 29, 1984

[30] Foreign Application Priority Data

Jul. 13, 1983 [AT] Austria ..... 2553/83

[51] Int. Cl.[4] ..... D01H 1/135; D01H 7/885

[52] U.S. Cl. ..... 57/401; 57/413

[58] Field of Search ..... 57/400, 401, 408, 411, 57/413

[56] References Cited

U.S. PATENT DOCUMENTS 4,202,163 5/1980 Turk et al. ..... 57/401
4,241,571 12/1980 Turk et al. ..... 57/401
4,392,343 7/1983 Parker et al. ..... 57/401

FOREIGN PATENT DOCUMENTS 2811882 10/1979 Fed. Rep. of Germany .

*Primary Examiner*—John Petrakes
*Attorney, Agent, or Firm*—Kurt Kelman

[57] ABSTRACT

Apparatus for making a yarn comprises two juxtaposed, closely spaced apart suction drums, which rotate in the same sense, and a fiber-guiding duct, which protrudes into the triangular space between the suction drums and serves to supply single fibers. In order to ensure a uniform tying of the single fibers into the yarn as it is formed, the length of the outlet opening of the fiber-guiding duct exceeds the average length of the longest fibers to be processed. Besides, the distance from the outlet opening of the fiber-guiding duct to the common diametral plane of the suction drums is such that the arc length of the periphery of each suction drum from the point which is nearest to said outlet opening to said common diametral plane is not in excess of 0.5 radians.

4 Claims, 2 Drawing Figures

II
II
1
4
5
6
7
8
9
a
l

APPARATUS FOR MAKING A YARN

BACKGROUND OF THE INVENTION

1. Field of the Invention

This invention relates to apparatus for making a yarn, comprising two juxtaposed and closely spaced apart suction drums which rotate in the same sense, and an inclined fiber-guiding duct which protrudes into the generally triangular space between the suction drums and closely adjoins the latter. The duct serves to supply single fibers which are to be twisted together to form a yarn.

2. Background of the Invention

In known apparatus of that kind, the single fibers are guided by the fiber-guiding duct into the triangular space between the two suction drums and are twisted together between the two suction drums so as to form a yarn. In that apparatus, the suction exerted by the suction drums results in a flow of air in the fiber-guiding duct so that the single fibers can be supplied in a controlled manner to the line in which the yarn is being formed. In order to ensure that each individual fiber will be aligned with the line in which the yarn is being formed, the fiber-guiding duct is arranged to extend at an acute angle to the line on which the yarn is being formed. But in spite of these measures, it has not always been possible to make yarns which meet all requirements because the single fibers are not uniformly tied into the yarn, particularly if one and the same apparatus is used to make yarns from single fibers having different average lengths.

SUMMARY OF THE INVENTION

It is an object of the invention to avoid these disadvantages and so to improve apparatus of the kind described first hereinbefore that an irregular tying-in of fibers will be avoided and uniform yarns will be obtained from single fibers having different average lengths, and to achieve this with means which are simple in structure.

This object is accomplished in accordance with the invention with an outlet opening of the fiber-guiding duct having a length, measured in the axial direction of the suction drums, which is at least as large as the average length of the longest individual fibers to be processed in the apparatus, the outlet opening of the fiber-guiding duct being so arranged that the arc length of the periphery of each suction drum from the point which is nearest to the outlet opening of the fiber-guiding duct to the common diametral plane of the suction drums is not in excess of 0.9 radians.

The invention is based on the recognition that only a restricted quantity of individual fibers per unit of length of the yarn can be tied in without a disturbance because only a limited quantity of singled fibers can be deposited on the yarn which is being formed. If the number of single fibers which are delivered is in excess of that limit, it will not be possible to tie in all said single fibers so that irregularities will necessarily result. Because the invention provides a fiber-guiding duct having an outlet opening which has a certain minimum length, it is ensured that the single fibers which are delivered are deposited on a sufficiently large region so that the number of single fibers which are to be tied into the yarn per unit of length thereof will be restricted as desired. Besides, the fibers are deposited in an area having at least a certain minimum length so that variations of the rate at which the individual fibers are supplied will be compensated at least in part. As the minimum length of the outlet opening of the fiber-guiding duct is selected in consideration of the average length of the longest fibers to be processed on a given apparatus, the desired conditions will be obtained also for fibers having a shorter average length.

But the tying in of the single fibers into the yarn will also be disturbed if the single fibers impinge on the surface of a drum before they are tied in. An impact of single fibers on the suction drum which rotates away from the nip between the drums will be particularly undesirable. In order to ensure that the fibers will fly freely as far as to the line on which the yarn is being formed, an upper limit is defined for the distance from the outlet opening of the fiber-guiding duct to the common diametral plane of the suction drums. It has been found that said distance should be so selected that the arc length of the periphery of each suction drum from the point which is nearest to the outlet opening to the diametral plane is not in excess of 0.9 radians. A lower limit for that distance is imposed by the fact that the outlet opening must have a certain minimum width because a sufficiently large cross-sectional area must be ensured so that a sufficiently high air flow rate will be produced in the fiber-guiding duct by the suction drums.

The length of the outlet opening cannot be as large as may be desired. Because a sufficiently coherent yarn will not be obtained unless a certain minimum quantity of single fibers is incorporated per unit of length of the yarn, the length of the outlet opening of the fiber-guiding duct should not exceed twice the average length of the longest single fibers which are to be processed. Under these conditions, yarns having good strength properties and having a high uniformity can be made. It has been found that particularly good results will be obtained if the distance from the outlet opening of the fiber-guiding duct to the common diametral plane of the two suction drums is so selected that the arc length of the periphery of each of the drums between the outlet opening and the common diametral plane is between 0.5 to 0.7 radians because this will ensure that the outlet opening has an adequate cross-sectional area and that the fibers will be properly directed to the line on which the yarn is being formed.

The single fibers supplied to the line on which the yarn is being formed should be aligned with that line as exactly as possible. For this reason, measures adopted to assist the alignment are of great importance. If the width of the outlet opening of the fiber-guiding duct, measured at right angles to the axial direction of the drums, increases in the direction in which the yarn is withdrawn, the resulting flow pattern in the fiber-guiding duct near the outlet opening will assist the aligning of the fibers with the line on which the yarn is formed so that the strength of the yarn can be increased.

DETAILED DESCRIPTION OF THE PREFERRED EMBODIMENT

Figure 1:
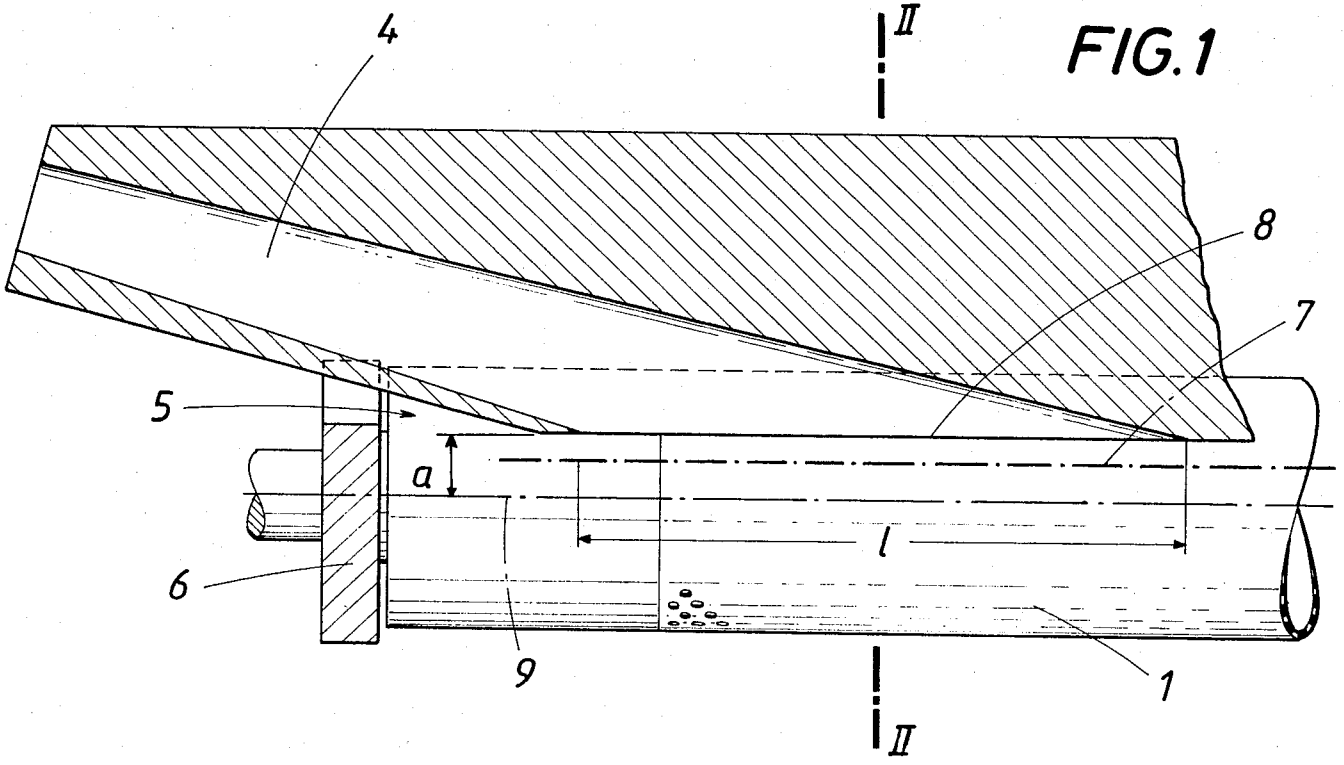
FIG. 1 is a simplified vertical sectional view showing apparatus according to the invention for making a yarn, the section being taken through the fiber-guiding duct.
Figure 2:
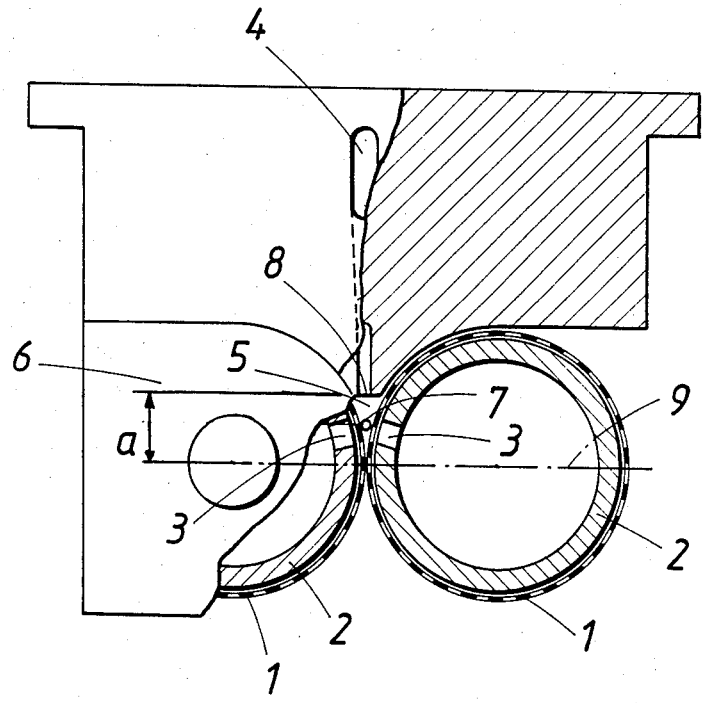
FIG. 2 is a view showing that apparatus partly in a section taken on line II—II in FIG. 1.

The invention is illustrated by way of example on the drawings.

The illustrated apparatus comprises two juxtaposed, closely spaced apart suction drums 1, which rotate in the same sense and each of which comprises a suction insert 2, which defines a suction slot 3. The latter extends axially and faces the generally triangular space between the two suction drums 1. A duct 4 is provided, which is inclined to the axial direction of the drums 1 and extends into the triangular space between the drums and along this space toward that end thereof from which the yarn which has been formed is withdrawn. Fibers which have been singled in fiber-singling apparatus and are to be twisted together to form a yarn are supplied by the duct 4 into the triangular space. The fiber-singling apparatus is not shown for the sake of clearness. The arrangement is such that the fiber-guiding duct 4 and the two suction drums 1 define between themselves a flow passage 5 for an axial stream of entrained air, which flows through a suitable aperture in a rear carrying plate 6. By the entrained air stream, the single fibers delivered by the inclined fiber-guiding duct 4 into the triangular space are given in the flow passage 5 an orientation in the direction of the line 7 on which the yarn is being formed so that the substantially parallel single fibers can be twisted together to form a yarn.

In order to ensure an undisturbed supply of the single fibers to the line 7 on which the yarn is formed and a uniform tying of the single fibers into the yarn being formed, the length l of the outlet opening 8 of the fiber-guiding duct 4, measured in the direction of the line 7 on which the yarn is being formed, is at least at large as the largest average length of all single fibers which can be processed on the apparatus. The average fiber length may lie between a value of 20 mm for natural fibers to a value of 60 mm for synthetic fibers. This means that the length l of the outlet opening 8 is at least 60 mm. Because the largest length l should not exceed twice the largest average fiber length, the largest length l should not exceed 120 mm in the case described. By that simple measure it is ensured that all single fibers which are delivered to the line on which the yarn is being formed can be directly tied into the yarn as it is formed and no fibers will be able to move in an uncontrolled manner between the yarn and the suction drums.

Besides, there is an upper limit to the distance a from the outlet opening 8 of the fiber-guiding duct 4 and the common diametral plane 9 of the two suction drums 1. As a result, an undesired impact of singled fibers on the suction drums 1 before the line on which the yarn is being formed can be effectively prevented so that a strong and highly uniform yarn can actually be made. For this purpose the largest possible distance a must be such that the arc length of the periphery of each suction drum from the point which is nearest to the outlet opening 8 to the common diametral plane 9 must not exceed 0.9 radians, i.e., 0.9 times the radius of the suction drum. Optimal conditions will be obtained if the distance a corresponds to an arc length of 0.5 to 0.7 radians. The smallest distance a corresponds to an arc length of about 0.3 radians because the suction of the suction drums 1 must be sufficiently effective in the fiber-guiding duct 4.

The fiber-guiding duct 4 may be designed with such a cross-sectional shape that a desired flow pattern and a desired action on the delivery of the fibers can be obtained. It will be desirable so to design the outlet opening 8 of the fiber-guiding duct 4 that the width of said outlet opening 8, measured at right angles to the line 7 on which the yarn is formed, increases toward that end of the generally triangular space from which the yarn is withdrawn, because such a design will promote the alignment of the singled fibers with the line 7 on which the yarn is being formed.

What is claimed is:

1. In apparatus for making a yarn from single fibers having an average length up to a predetermined upper limit, which apparatus comprises two juxtaposed and closely spaced apart suction drums having the same axial direction and defining a common diametral plane, said drums defining between them a generally triangular space which tapers to said common diametral plane and being adapted to be rotated in the same sense, and a fiber-guiding duct which extends at an acute angle to the axial direction of said drums into and toward one end of said generally triangular space and has an outlet opening which is disposed in said generally triangular space close to both said drums, said duct being adapted to deliver said single fibers through said outlet opening to said generally triangular space so that said drums, when rotating in the same sense, are adapted to twist said single fibers together to form a yarn extending in said axial direction, the improvement comprising that the length of said outlet opening in said axial direction is at least as large as said upper limit of said average length and not in excess of twice the upper limit of said average length, and said outlet opening is so arranged that the arc length of the periphery of each of said drums from the point which is nearest to said outlet opening to said common diametral plane is not in excess of 0.9 radians.

2. The improvement set forth in claim 1, wherein said outlet opening is so arranged that the arc length of the periphery of each of said drums from the point which is nearest to said outlet opening to said common diametral plane is between 0.5 and 0.7 radians.

3. The improvement set forth in claim 1, wherein the width of said outlet opening, measured at right angles to said axial direction, increases toward said one end of said generally triangular space.

4. In apparatus for making a yarn from single fibers having an average length between 20 and 60 millimeters which apparatus comprises two juxtaposed and closely spaced apart suction drums having the same axial direction and defining a common diametral plane, said drums defining between them a generally triangular space which tapers to said common diametral plane and being adapted to be rotated in the same sense, and a fiber-guiding duct which extends at an acute angle to the axial direction of said drums into and toward one end of said generally triangular space and has an outlet opening which is disposed in said generally triangular space close to both said drums, said duct being adapted to deliver said single fibers through said outlet opening to said generally triangular space so that said drums, when rotating in the same sense, are adapted to twist said single fibers together to form a yarn extending in said axial direction, the improvement comprising that the length of said outlet opening in said axial direction is at least 60 millimeters and not in excess of 120 millimeters; and said outlet opening is so arranged that the arc length of the periphery of each of said drums from the point which is nearest to said outlet opening to said common diametral plane is not in excess of 0.9 radians.

* * * * *